US006378725B1

(12) United States Patent
Granger

(10) Patent No.: US 6,378,725 B1
(45) Date of Patent: Apr. 30, 2002

(54) AUTOMATIC OR SEMIAUTOMATIC WIPING MATERIAL AND TOILET PAPER DISPENSING APPARATUS

(76) Inventor: Maurice Granger, 17 Rue Marcel Pagnol, 42270 Saint Priest en Jarez (FR)

( * ) Notice: Subject to any disclaimer, the term of this patent is extended or adjusted under 35 U.S.C. 154(b) by 0 days.

(21) Appl. No.: 09/673,404

(22) PCT Filed: Mar. 22, 1999

(86) PCT No.: PCT/FR99/00656

§ 371 Date: Oct. 17, 2000

§ 102(e) Date: Oct. 17, 2000

(87) PCT Pub. No.: WO99/55214

PCT Pub. Date: Nov. 4, 1999

(30) Foreign Application Priority Data

Apr. 24, 1998 (FR) ..... 98 05453

(51) Int. Cl.[7] ..... G07F 11/72

(52) U.S. Cl. ..... 221/30; 83/337

(58) Field of Search ..... 221/30, 33, 45, 221/42; 83/337, 335, 649, 678

(56) References Cited

U.S. PATENT DOCUMENTS

| | | | |
|---|---|---|---|
| 4,441,392 | A | 4/1984 | Deluca |
| 5,048,386 | A | 9/1991 | Deluca |

FOREIGN PATENT DOCUMENTS

| | | |
|---|---|---|
| WO | 94 17715 | 8/1994 |
| WO | 96 03912 | 2/1996 |

*Primary Examiner*—Kenneth W. Noland
(74) *Attorney, Agent, or Firm*—Wall Marjam & Bilinski LLP

(57) ABSTRACT

The invention concerns an apparatus characterized in that the drum (6) has on an angular sector ($\alpha$) of its periphery a zone (17) with increased thickness capable of being in contact with the pressing means (11) substantially retractable in position through a float mounting to absorb the drum thickness modifications, in rotating phase when the material strip is pulled up to its cutting line.

8 Claims, 3 Drawing Sheets

AUTOMATIC OR SEMIAUTOMATIC WIPING MATERIAL AND TOILET PAPER DISPENSING APPARATUS

BACKGROUND OF THE INVENTION

The invention relates to the technical field of apparatuses for dispensing paper wipes, made of cellulose wadding, creped paper or suchlike material intended more particularly for wiping the hands of users, and toilet paper.

Very many types of automatically operating wiper apparatus exist and the Applicant has developed several apparatuses of this type with automatic or semiautomatic operation capable of dispensing strips of folded or unfolded material.

These apparatuses, which give satisfactory service, are of the type comprising a moulded plastic housing accommodating in its upper part a feed reel of wiping material, a drum containing a cutter device with a serrated blade, and a presser means for feeding the strip of paper towards the drum and tensioning the paper. The cutter blade is pivoted inside the drum and moved by engagement of a toothed spur connected to the pivot of the cutter blade, and engaging with a fixed rack means positioned internally on one of the sides of the housing. This drum is also provided with a cocking mechanism with a crank and return spring as described and illustrated in the Applicant's French patent. A cover protects the mechanisms.

U.S. Pat. No. 4,441,392 discloses the fitting of the drum in a cutting dispensing apparatus with projecting points arranged at the ends of the drum to permit separation of the paper as the drum turns, and to facilitate its cutting.

Again, French Patent No. 2,555,975 in the name of the applicant discloses the fitting of the drum around its periphery with projections in the form of catching spikes or points whose function is to prevent the free strips of paper pulled around two rollers at a time from slipping relative to each other.

A dispensing apparatus in accordance with the preamble of Claim 1 is also disclosed in PCT Patent WO A 96/03912.

While these apparatuses of the abovementioned type, which are in widespread use, work very reliably with paper wipes of new manufacture, certain cutting difficulties arise when using recycled papers, unfolded papers of great width and folded papers that comprise several juxtaposed thicknesses.

SUMMARY OF THE INVENTION

This is due to the fact that the tensioning of the paper before it is cut is not always constant owing to the nature and properties of the material and the manner in which the end of the strip of paper is pulled by the user.

The Applicant was therefore concerned with solving this problem by seeking initially to improve the application of pressure by the presser means to the drum, by attempting to discover the most appropriate calibration for the elastic return means.

In practice, the results not being uniform, the Applicant turned unexpectedly to the manner of operation of the drum containing the cutter device.

Thus, according to the invention, the distinctive feature was the modification of the constant initial circular section of the drum by variation of its external profile around part of its periphery, so that it could act in certain stages of operation of the apparatus and of cut dispensing of a strip of paper with the best possible tension applied to the paper.

According to the invention, around an angular sector of the periphery of the drum is a region of increased thickness defined between the edge of the opening for the passage of the cutter blade and a line corresponding to the axial plane with its edge on the axis at the end of which the crank is linked and attached, enabling cocking of the drum in preparation for the cut, the said region of complementary thickness being in contact with the presser means which is generally retractable, in terms of its position, on a floating mounting so as to absorb the changes in the thickness of the drum during the period of tension on the pulled strip of paper followed by cutting of the said paper.

These features and others also will become clear in the remainder of the description.

BRIEF DESCRIPTION OF THE DRAWINGS

In order to provide a clear idea of the subject of the invention, illustrated in a non-restrictive manner in the figures of the drawings in which.

DESCRIPTION OF THE INVENTION

Figure 1:
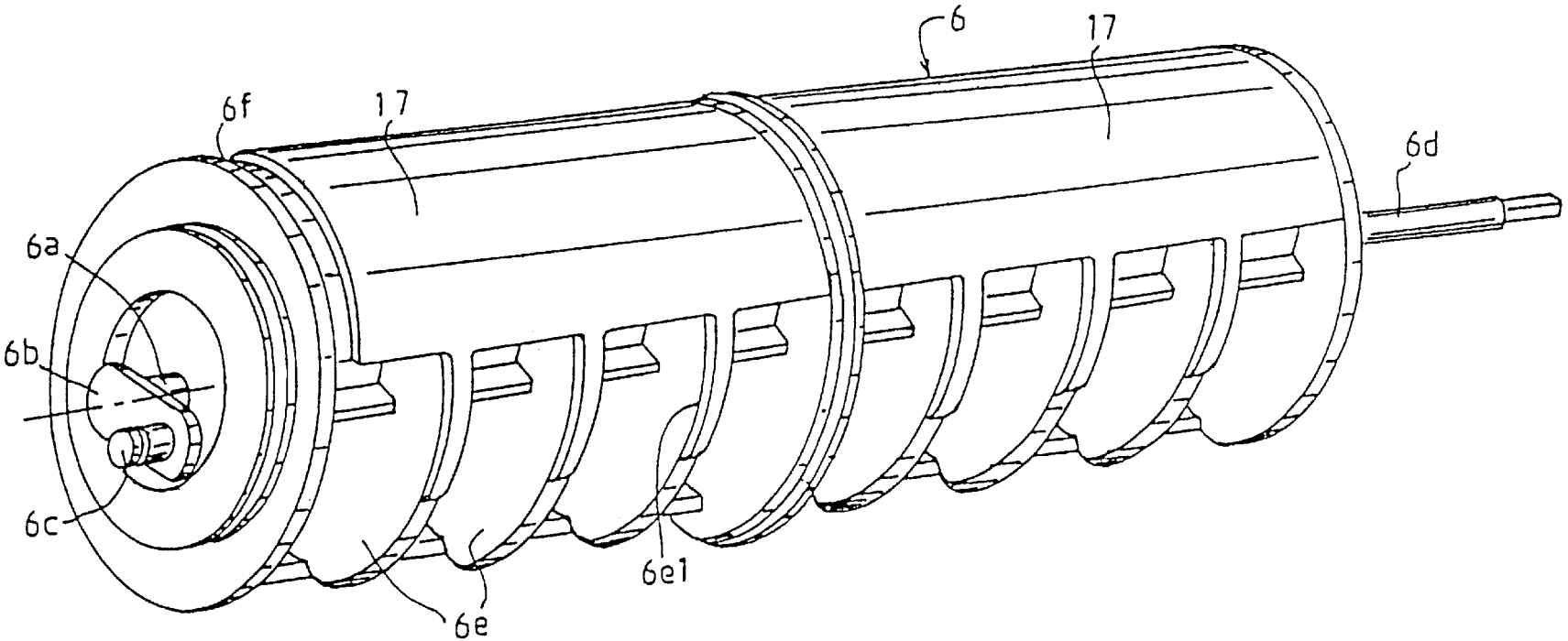
FIG. 1 is a perspective view of the drum of the invention capable of being engaged in the wiping material dispensing apparatus of the aforementioned type; shown without its paper gripping covering.

In order to render the subject of the invention more concrete, it is described in a non-restrictive manner illustrated in the figures of the drawings.

The apparatus according to the invention containing the improved drum and the floating mounting of the presser means on the drum, helping to ensure constant tension on the strip of wiping material, is suitable for dispensing the automatically or semiautomatically cut piece of wiping material made of any appropriate material, cellulose wadding, creped paper and suchlike, whether folded or unfolded, for wiping the hands or the dispensing of toilet paper.

The construction of an apparatus for dispensing hand towels and toilet paper denoted as a whole by (1) will now be rapidly and succinctly reviewed.

The apparatus comprises a moulded plastic housing (2) able to accommodate in its upper part a feed reel (3) of wiping material or toilet paper held between upper side plates (4) fitted by rapid assembly or other means to the back of the housing.

Lower side plates (5) are inserted and fixed by rapid assembly or other means, to the rear face **(2*a*) of the housing and are provided with slots (5*a*) allowing fixing and rapid assembly of the drum (6) containing its cutter device (7) with its serrated blade (7*a*). The said cutter device is pivoted, in the manner described earlier, with a toothed spur mechanism (8) connected to the cutter blade which engages with a fixed rack (9) set on the inner side piece (5*b*) of one of the side plates (5) of the housing. The drum has a longitudinal opening (6*f*)** to allow the cutter blade to extend out.

The drum is constructed in a known manner corresponding to the teaching of French Patent No. 7,604,664. One end is positioned and centred on one of the side plates of the housing (5), while the other end has a shaft (6*a*) passing out through the other side plate to be engaged firmly in a corresponding slot (5*a*) in the said side plate.

Figure 2:
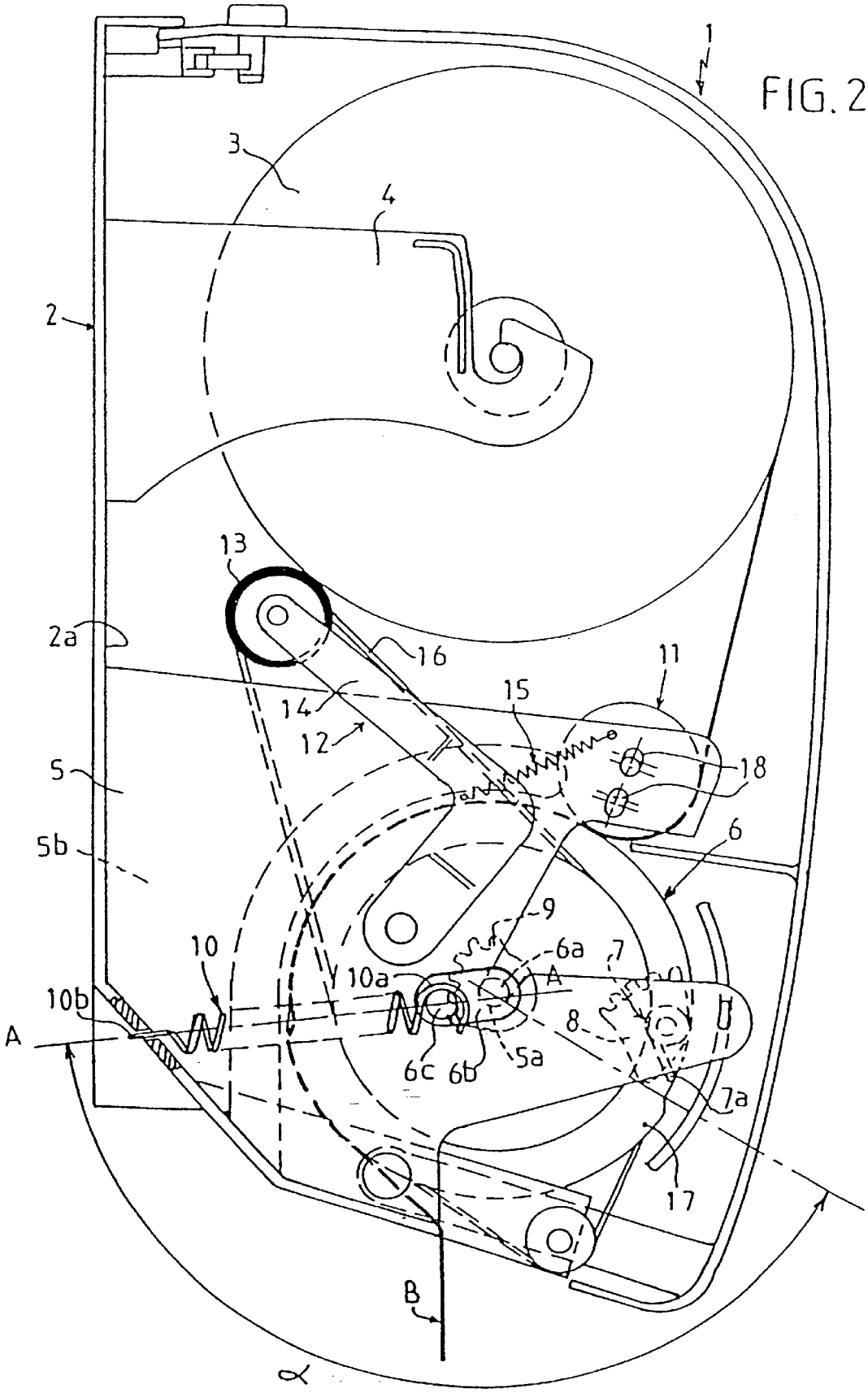
FIG. 2 is a side view of the apparatus for dispensing wiping material with the cover removed, illustrating the various components of the apparatus, and in particular the drum and the floating mounting of the presser means.

The said shaft (6*a*) comprises a cranked shape (6*b*), the end (6*c*) of which forms a pin which provides the point of attachment for one end (10*a*) of a return and cocking spring (10). The latter has its other end (10*b*) fixed to the housing at the rear of the adjacent side plate (5). A presser means (11) in the form of a cylinder is the same length as the drum and can press on the latter when positioned between the aforementioned side plates (5). As illustrated in FIG. 2 of the drawings, the dispensing apparatus, which thus far is known, may additionally but not necessarily be fitted with a non-return device (12) for preventing run-back of the strip of wiping material, thus comprising a roller (13) pressing on the reel of wiping material, this roller being positioned between the side plates (5) of the housing or on a cranked lever (14) acted upon by an elastic return means (15) fixed to the side plates (5) of the housing. A belt (16) can be run around the drum (6) and around the anti-looping roller.

Figure 3:
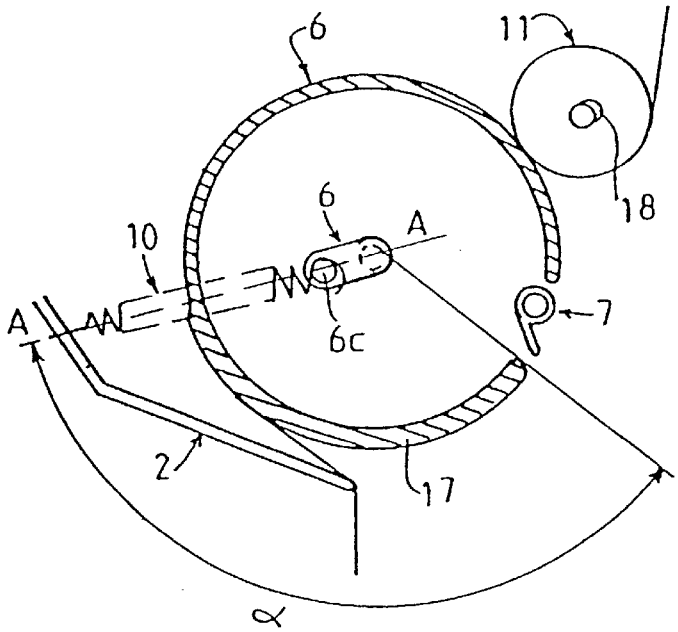
FIGS. 3, 4 and 5 are diagrammatic views illustrating the position of the drum during the cutting action, and in particular the successive positions of the region of increased thickness with which the drum is provided as well as the relative position of the presser means.

The invention can now be described. The drum (6), which is constructed in the form of a cylinder and is possibly hollow, comprises, around part of its outer periphery and occupying a defined angular sector ($\alpha$), a continuous enlarged region (17) whose function is to be in contact, in certain phases of the operation of the apparatus, with the presser means (11), displacing it on a floating mounting in oval seatings or openings (18) formed in the side plates (5) for the ends of the presser means (11). This continuous region of increased thickness (17) may be of the order of 0.7 mm to 1.5 mm according to requirements. Referring to FIG. 3 illustrating the apparatus in the non-operating phase, the region of increased thickness is formed between the edge (19) of the longitudinal opening (6*f*) for the passage of the cutter blade of the cutter device and a line AA representing a plane between the connecting shaft (6*a*), to the end of which the crank (6*b*) is attached, and the return and cocking spring (10), with an angular sector ($\alpha$) of around 120° to 130°. This region of increased thickness (17) may consist of a wall that is shaped and attached or a wall that is directly formed along the full length ($\alpha$) of the drum in the sector in question.

FIG. 1 of the drawings shows an illustrative embodiment of a drum (6) that comprises, on its central shaft (6*d*), a plurality of radial discs (6*e*), thus permitting a reduction of the weight of the said drum. In this form, the wall (17) of increased thickness extends as shown in the drawings around part of the periphery (6*e*1) of the radial discs (6*e*) roughly to the axial plane of the line AA as described earlier. In order that the drawings may be understood, the high-grip covering (emery cloth) covering part of the drum has been removed.

Thus, according to the invention, the angular sector ($\alpha$) corresponding to this region of increased thickness is of the order of 110 to 140°.

In accordance with another complementary provision of the invention, the openings (18) formed in the side plates for reception of the presser means (11) are made oval to allow a free and floating mounting of the said presser means (11). The depth of these oval openings is such that they absorb the displacement of the presser means (11) in contact with the drum (6) when the said presser means (11) is pressing on and rolling over the region of increased thickness formed on the said drum.

The said side plates (5) may advantageously be provided with several pairs (18) of oval slots or holes, so that drums of different diameters can be positioned.

Figure 4:
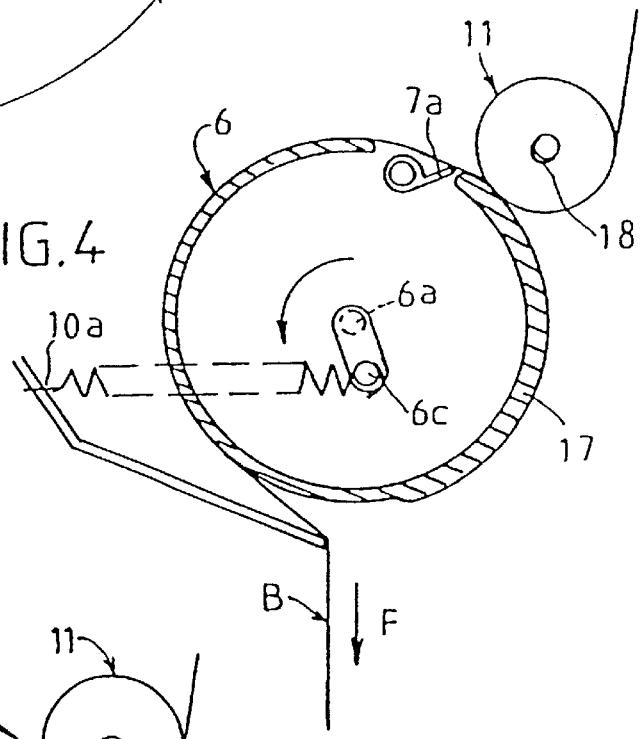
Figure 5:
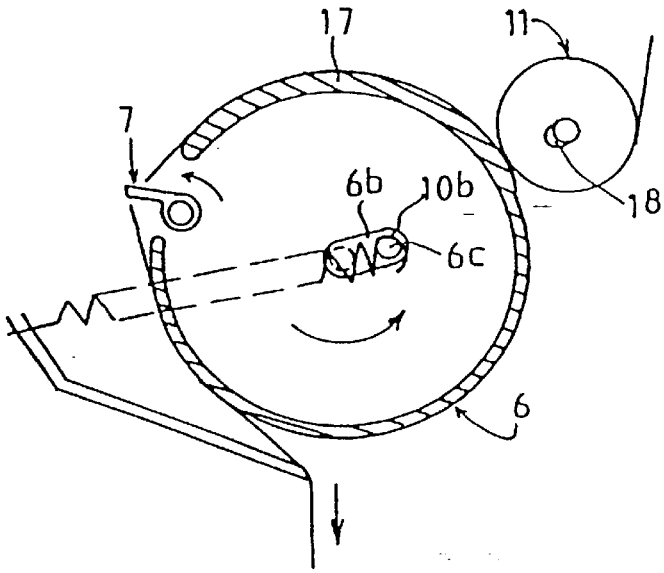

Reference should now be made to FIGS. 3, 4 and 5 of the drawings which schematically show the rotation of the drum (6) when the end of the strip (B) of material is pulled by the user, and hence the cutting of the strip of paper to the predetermined dimensions.

In FIG. 3 corresponding to the initial phase of non-operation, and of cutting the region of increased thickness (17) of the drum is at the bottom of the latter, not in contact with the presser means (11).

In FIG. 4 the arrow (F) shows how the pulling of the end of the strip of paper has caused a partial rotation of the drum (6) and brought the presser means (11) into contact with the region of increased thickness (17) while the cutter blade (7*a*) is just touching the strip of stretched paper as it leaves the region of contact and of pressure between the presser means (11) and the drum (6).

FIG. 5 corresponds to the phase of maximum cocking of the drum (6) with return action, corresponding to the situation in which the spring (10) connected to the crank (6*b*) is at maximum stretch. In this phase the cutter blade (7*a*) is protruding for the cut, while the presser means (11) is in contact with the end of the region of increased thickness (17) formed on the drum (6).

The operating action described above highlights the desired action on which the invention is based, namely a constant tension exerted on the pulled paper strip during the process of dispensing followed by cutting. After the sector has passed, the removal of this pressure allows the strip of material to pulled out very easily without resistance.

The invention thus enables the improved drum (6) and the floating mounting of the presser means (11) to be used to permit the cutting of any wiping material or toilet paper, folded or unfolded and of whatever material.

The internal features of the drum may be of any kind. The example illustrated in FIG. 1 of the drawings is illustrated as one possible embodiment. The original feature is the formation around an angular sector ($\alpha$) of the periphery of the said drum of a region of thickness (17) around a sector corresponding approximately to the contact of the cutter blade with the strip of paper wipe that is to be cut after the pressure is applied between the presser means and the drum up until the final phase of the cut.

The advantages will be clear from the description.

What is claimed is:

1. Apparatus for dispensing a wiping material and toilet paper, with automatic or semiautomatic operation, of the type comprising a housing accommodating in its upper part a feed reel of wiping material, a supporting drum mounted between fixed internal side plates of the said housing, the said drum having a slot for locating and pivoting a cutter device with a serrated blade, and a presser means pressing on the drum in order to feed and tension the strip of paper passing between them, the said cutter blade being pivoted inside the drum and moved by engagement of a toothed spur connected to the cutter blade, and engaging with a fixed rack means positioned on one of the side plates of the housing, and the said drum being provided with a cocking means with a crank and return spring, wherein and around an angular sector ($\alpha$) of the periphery of the drum is a region of increased thickness capable of being in contact with the presser means which is generally retractable, in terms of its position, on a floating mounting so as to absorb the changes in the thickness of the drum, during its rotation, when the strip of material is pulled until cut.

2. Dispensing apparatus according to claim 1, wherein the region of increased thickness is defined between the edge of the opening for the passage of the cutter blade and a line A—A corresponding to the axial plane between the connecting shaft, to the end of which the crank is attached, and the return and cocking spring, with an angular sector ($\alpha$) of around 120° to 130°, this region of increased thickness consisting of a wall that is shaped and attached or a wall that is directly formed along the full length ($\alpha$) of the drum in the sector in question.

3. Dispensing apparatus according to claim 1, wherein the continuous region of increased thickness is between about 0.7 mm and 1.5 mm.

4. Dispensing apparatus according to claim 1, wherein the continuous region of increased thickness consists of a wall attached to the periphery of the drum around an angular section.

5. Dispensing apparatus according to claim 1, wherein the angular sector of the region of increased thickness if between about 110 and 140°.

6. Dispensing apparatus according to claim 1, wherein the drum comprises, on a central shaft, a plurality of radial discs (6*e*), the region of increased thickness extending around part of the periphery of the said discs.

7. Dispensing apparatus according to claim 1, wherein the presser means is positioned in oval openings made in the supporting side plates to allow a floating mounting in response to the rotation of the drum.

8. Dispensing apparatus according to claim 7 wherein the side plates contain a plurality of oval openings for the positioning of drums of different diameters.

* * * * *